United States Patent [19]

Hardie et al.

[11] Patent Number: 4,490,723

[45] Date of Patent: Dec. 25, 1984

[54] PARALLEL PLATE LENS ANTENNA

[75] Inventors: George S. Hardie, Santa Barbara; Raphael Hernandez, Oxnard; Michael J. Maybell, Santa Barbara, all of Calif.

[73] Assignee: Raytheon Company, Lexington, Mass.

[21] Appl. No.: 455,398

[22] Filed: Jan. 3, 1983

[51] Int. Cl.[3] ..... H01Q 15/02

[52] U.S. Cl. ..... 343/754; 343/909

[58] Field of Search ..... 343/368, 371, 372, 754, 343/909, 911 R

[56] References Cited

U.S. PATENT DOCUMENTS 4,222,054 9/1980 Capps ..... 343/754

*Primary Examiner*—Eli Lieberman

*Attorney, Agent, or Firm*—Richard M. Sharkansky; Joseph D. Pannone

[57] ABSTRACT

An antenna system is provided for producing a plurality of differently directed beams of electromagnetic energy, each one of such beams being associated with a corresponding one of a plurality of beam ports, each one of such beams being produced from a common array of antenna elements. The antenna system includes a radar frequency energy lens assembly having a plurality of array ports coupled to the plurality of antenna elements. The lens assembly includes a radio frequency lens having a plurality of lens ports disposed about peripheral portions thereof. Each one of a first portion of such plurality of lens ports is coupled to a corresponding one of the antenna elements through a corresponding one of the array ports and each one of a second, opposing portion of the plurality of lens ports being coupled to a corresponding one of the beam ports. Each one of the lens ports in one of the portions thereof includes a pair of tapered feeds. A power divider/combiner is provided for each one of the pair of tapered feeds, such power divider/combiner having a pair of branch lines coupled to the pair of tapered feeds and a common line coupled to the one of the beam ports or array ports coupled to such lens port. The electrical lengths between an input to the common line and the outputs of the pair of tapered feeds coupled to the branch lines of such power divider/combiner are equal.

6 Claims, 7 Drawing Figures

PARALLEL PLATE LENS ANTENNA

BACKGROUND OF THE INVENTION

This invention relates generally to radio frequency antennas and more particularly to multibeam antennas adapted to operate over a relatively wide band of frequencies.

As is known in the art, an array antenna may be arranged so that it produces a plurality of simultaneously existing beams of radio frequency energy. One such antenna is described in U.S. Pat. No. 3,761,936, Multi-Beam Array Antenna, inventors Donald H. Archer, Robert P. Pricket and Curtis P. Hartwig, issued Sept. 25, 1973 and assigned to the same assignee as the present invention. As described therein, the array antenna is adapted to produce a plurality of simultaneously existing beams of radio frequency energy, each one thereof having the gain and bandwidth of the entire aperture. Such array antenna has a wide range of applications, such as in a relay or transponder as described in U.S. Pat. No. 3,715,749, Multi-Beam Radio Frequency System, inventor Donald H. Archer, issued Feb. 6, 1973, and assigned to the same assignee as the present invention. As described therein, in one application a pair of multi-beam array antenna is used; one for reception, and one for transmission. Radio frequency energy along a particular wavefront is formed to a particular output port of the array, detected, fed to a corresponding input port of the transmitting array and retransmitted back along the same direction as the received wavefront. In many applications of such type, it is frequently desired that the antenna system operate over a relatively wide band of frequencies.

SUMMARY OF THE INVENTION

In accordance with the present invention, an antenna system is provided for producing a plurality of differently directed beams of electromagnetic energy, each one of such beams being associated with a corresponding one of a plurality of beam ports, each one of such beams being produced from a common array of antenna elements. The antenna system includes a radio frequency energy lens assembly having a plurality of array ports coupled to the plurality of antenna elements. The lens assembly includes a radio frequency lens having a plurality of lens ports disposed about peripheral portions thereof. Each one of a first portion of such plurality of lens ports is coupled to a corresponding one of the antenna elements through a corresponding one of the array ports and each one of a second, opposing portion of the plurality of lens ports being coupled to a corresponding one of the beam ports. Each one of the lens ports in one of the portions thereof includes a pair of tapered feeds. A power divider/combiner is provided for each one of the pair of tapered feeds, such power divider/combiner having a pair of branch lines coupled to the pair of tapered feeds and a common line coupled to the one of the beam ports or array ports coupled to such lens port. The electrical lengths between an input to the common line and the outputs of the pair of tapered feeds coupled to the branch lines of such power divider/combiner are equal.

With such arrangement, the antenna system is adapted to operate over a relatively wide band of frequencies. In particular, such antenna system, and in particular the radio frequency lens thereof, has improved performance when operating with radio frequency energy having a wavelength $\lambda$, in the range $(d/0.52)>\lambda>(d/0.64)$, where d is the separation between adjacent ones of the plurality of lens ports.

BRIEF DESCRIPTION OF THE DRAWINGS

For a more complete understanding of the invention, reference is made to the following description of a preferred embodiment of the invention in conjunction with the accompanying drawings, in which.

DESCRIPTION OF THE PREFERRED EMBODIMENT

Figure 1:
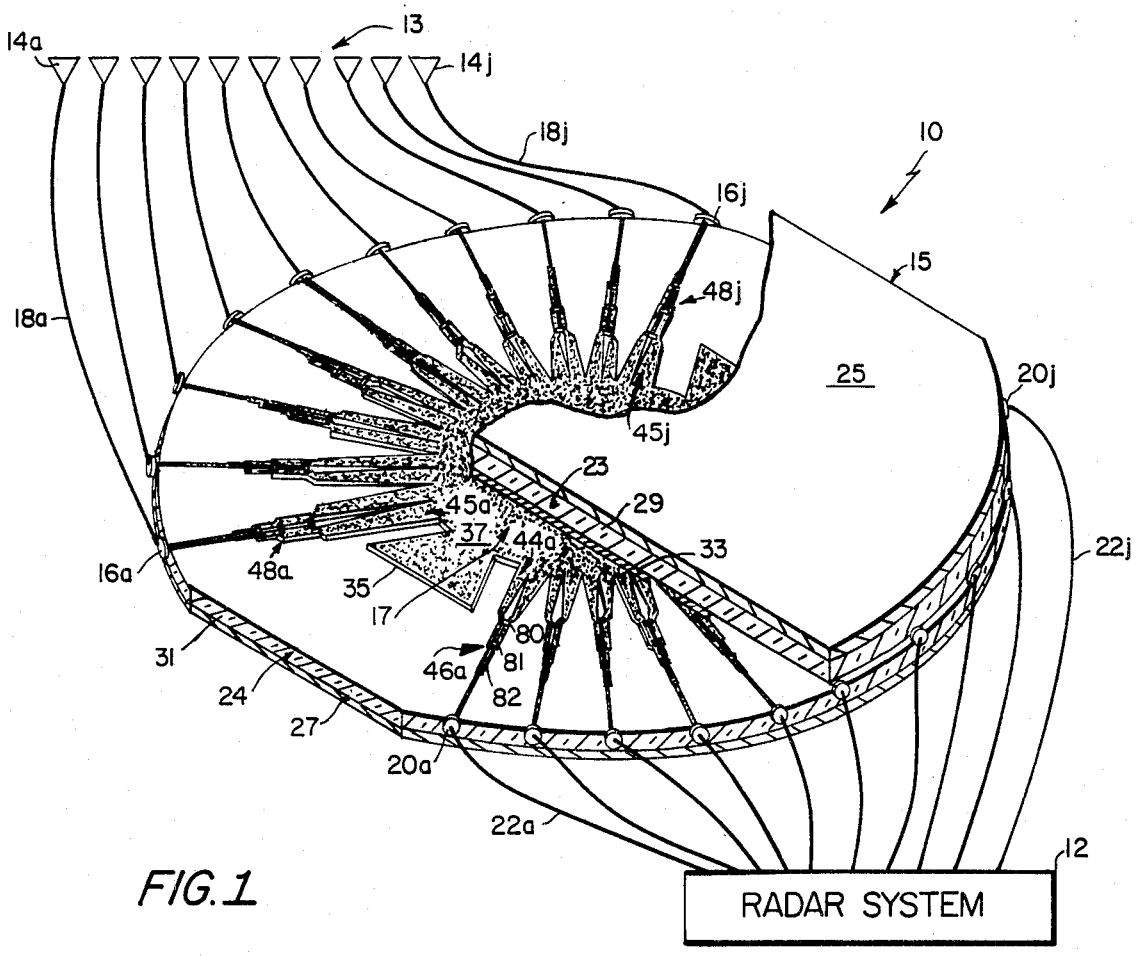
FIG. 1 is an isometric view, partially broken away of a radio frequency, strip transmission line, lens assembly according to the invention coupled to an array of antenna elements to provide an array antenna for a radar system coupled to the lens assembly.

Referring now to FIG. 1, a multi-beam array antenna 10 is shown coupled to a radar system 12 in a conventional manner. The multi-beam antenna 10 includes an array 13 of antenna elements **14*a* to 14*j*, each one of such antenna elements being coupled to a corresponding one of a plurality of array ports 16*a* to 16*j* of a radio frequency, strip transmission line, lens assembly 15 through a plurality of coaxial transmission lines 18*a* to 18*j*, as shown. The radar system 12 is coupled to a plurality of beam ports 20*a* to 20*j* of the radio frequency lens assembly 15 through coaxial transmission lines 22*a* to 22*j*, respectively as shown. As described in U.S. Pat. No. 3,761,936 referred to above, the array antenna 10 is adapted to produce a plurality of simultaneously existing beams of radio frequency energy, each one of such beams being produced by the common array 13 of antenna elements 14*a* to 14*j*, each one of such beams having the gain and bandwidth of the entire aperture, each one of such beams being associated with a corresponding one of the beam ports. Thus, here the array antenna 10 is adapted to produce 10 beams of radio frequency energy, each one of such beams being associated with a corresponding one of the beam ports 20*a* to 20*j* being produced from the array 13 of antenna elements 14***a* to 14*j*.

Figure 2:
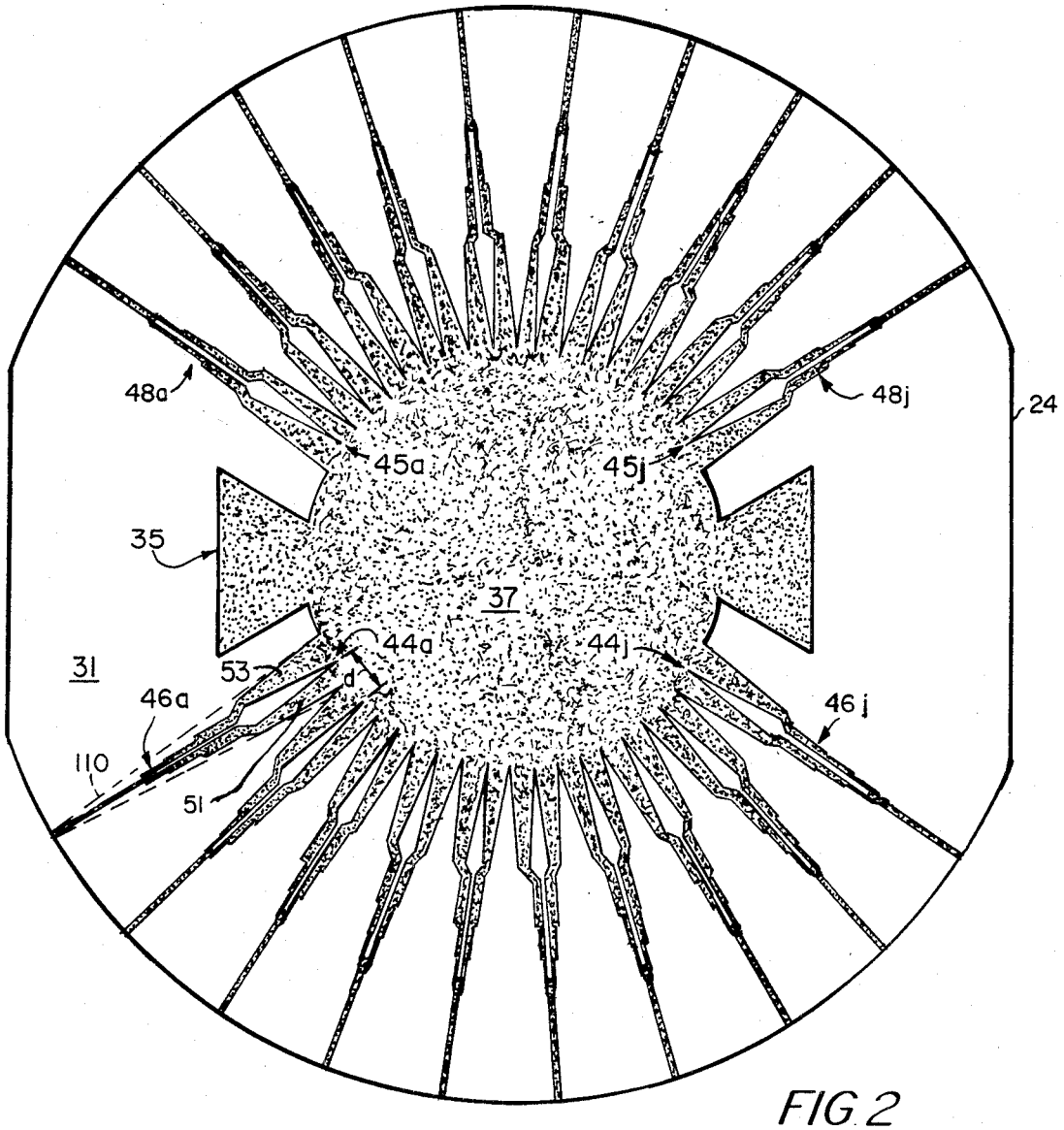
FIG. 2 is a plan view of center conductor circuitry disposed on one of a pair of dielectric substrates of the radio frequency, strip transmission line, lens assembly of FIG. 1.
Figure 3:
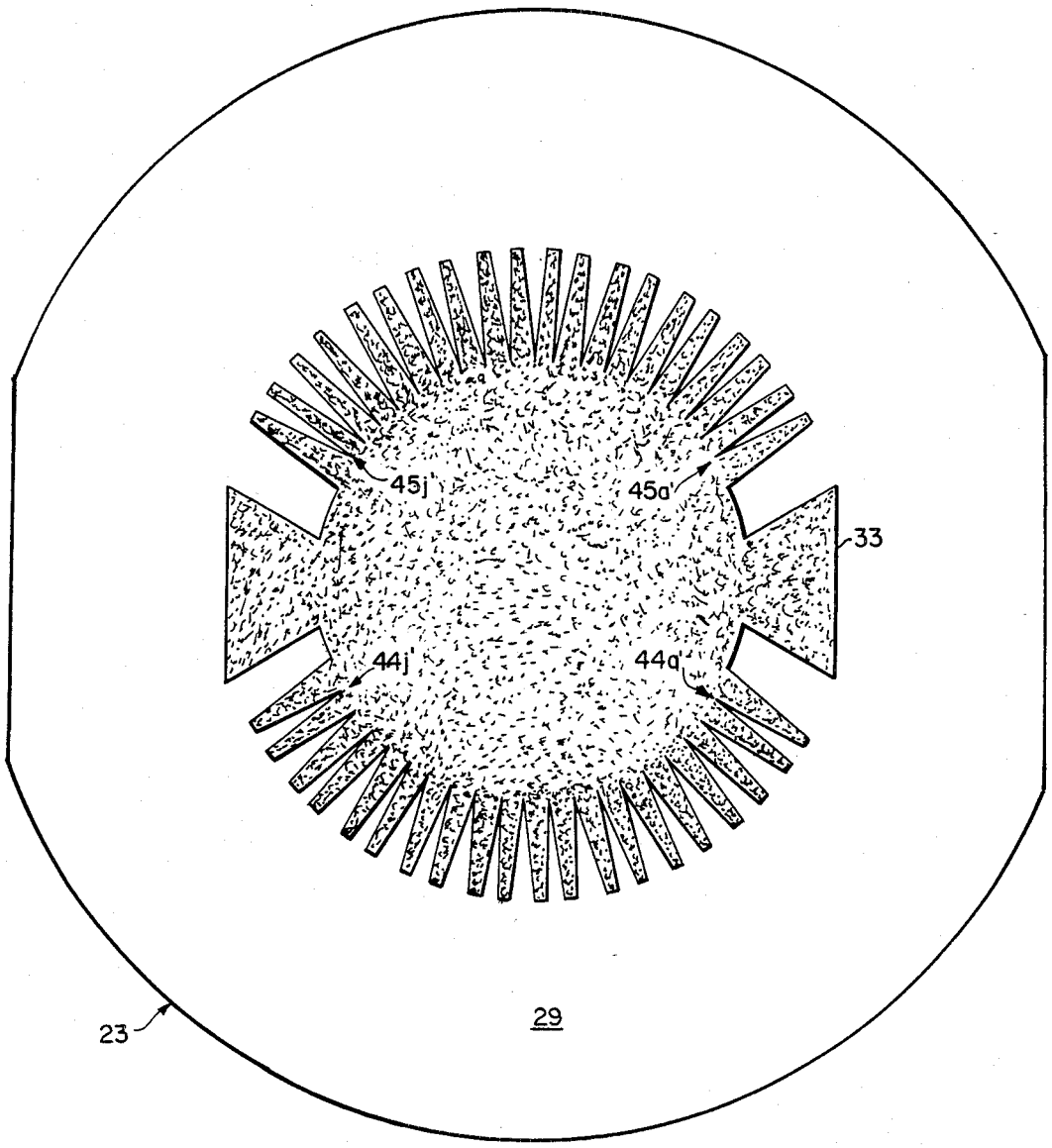
FIG. 3 is a plan view of center conductor circuitry disposed on one of the pair of dielectric substrates of the lens assembly of FIG. 1.
Figure 4:
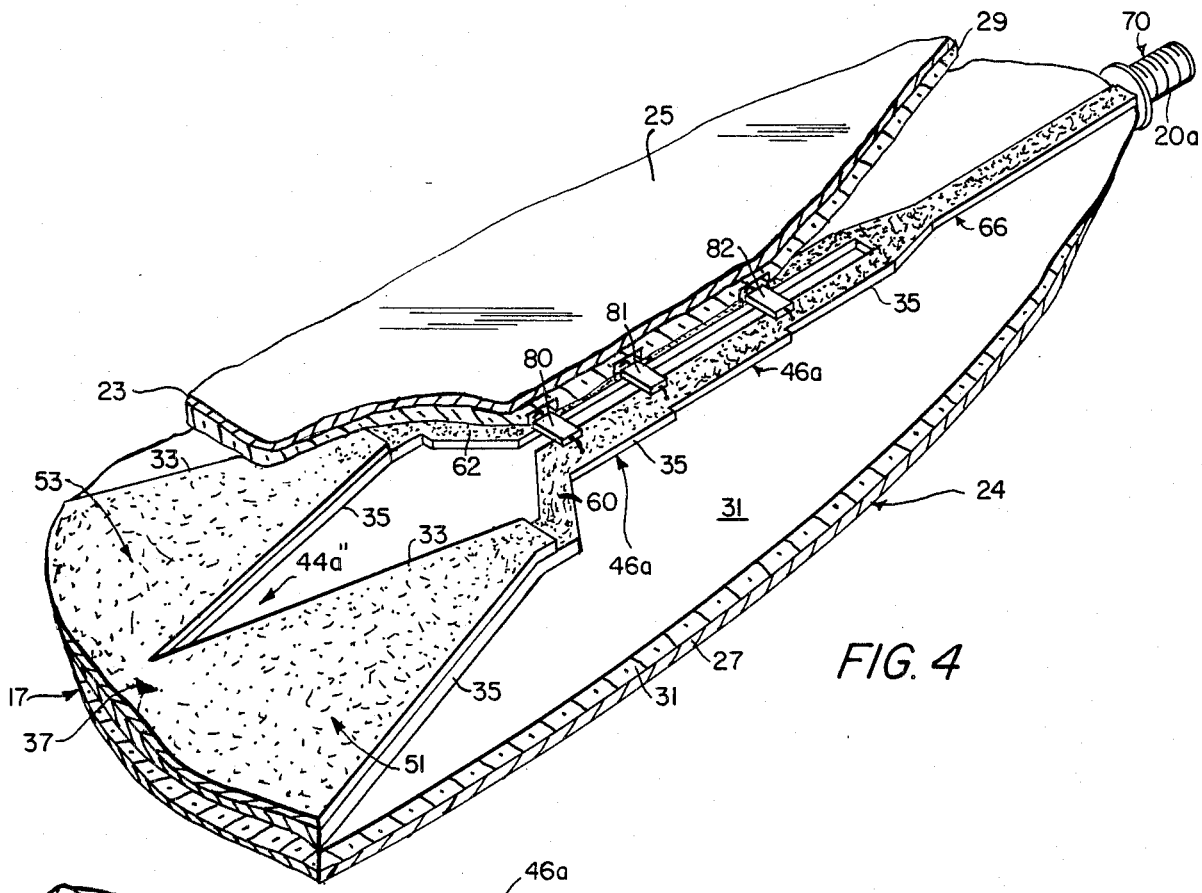
FIG. 4 is a fragmented, isometric view showing an exemplary lens port and power divider/combiner used in the radio frequency, strip transmission line, lens assembly of FIG. 1.
Figure 5:
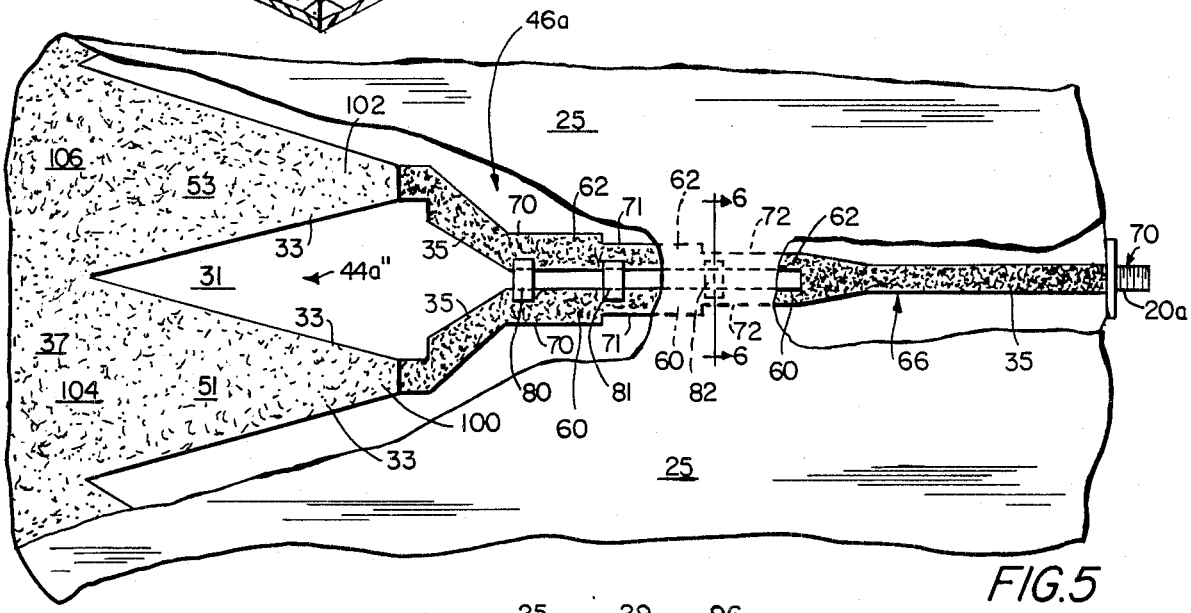
FIG. 5 is a plan view of the exemplary lens port and power divider/combiner of FIG. 4.
Figure 6:
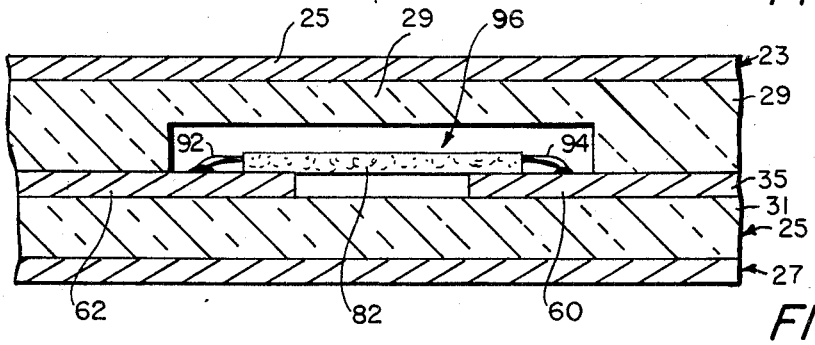
FIG. 6 is a cross-sectional elevation view, somewhat distorted, of a portion of a strip transmission line power divider/combiner shown in FIG. 5, such cross-section being taken along line 6—6 of FIG. 5.

The radio frequency lens assembly 15 here includes a strip transmission line parallel plate radio frequency lens 17. More particularly, the lens assembly 15 includes two, substantially identical printed circuit boards 23, 24, each one having a conductive, here copper, layer to provide ground plane conductors 25, 27 disposed on the outer surfaces of dielectric substrates 29, 31, respectively as shown. Formed on the inner surfaces of the dielectric substrates 29, 31 are center conductor circuitry 33, 35 for the strip transmission line lens assembly 15, such center conductor circuitry being formed using conventional photolithographic-chemical etching processes. The center conductor circuitries 33, 35 formed on the inner surfaces of the dielectric substrates 29, 31 are substantially identical in the central regions. The center conductor circuitry 35 formed on the upper surface of dielectric substrate 31, is shown in FIG. 2, and the center conductor circuitry 33 formed on the lower surface of dielectric substrate 29 is shown in FIG. 3. Thus, referring also to FIG. 2, center conductor circuitry 35 includes a central region 37 which provides, together with the corresponding portion 37' of the center conductor circuitry 33 of the upper printed circuit board 23 (FIG. 3), the center conductor circuitry for the parallel plate, strip transmission line, radio frequency lens 17. A plurality of lens port portions 44*a* to 44*j* and 45*a* to 45*j* are disposed about the periphery of the central region 37 and a plurality of lens port portions 44'*a* to 44'*j* and 45'*a* to 45'*j* are disposed about the periphery of region 37'. Each one of a first portion of the lens ports, in particular each one of the lens ports 44*a* to 44*j* is coupled to a corresponding one of the beam ports 20*a* to 20*j*, respectively, through a corresponding one of a plurality of strip transmission line power divider/combiners 46*a* to 46*j*, respectively, as shown in FIG. 1 for combiner 46*a*. Each one of a second, opposing portion of the lens ports, in particular each one of the lens ports 45*a* to 45*j* is coupled to a corresponding one of the array ports 16*a* to 16*j* through a corresponding one of a plurality of strip transmission line power divider/combiners 48*a* to 48*j* for exemplary combiner 48*a*, as shown in FIG. 1. Each one of the power divider/combiners 46*a* to 46*j*, 48*a* to 48*j*, is identical in construction. An exemplary one thereof here power divider/combiner 46*a* is shown in detail in FIGS. 4, 5 and 6 along with a portion of the parallel plate lens 17 coupled thereto in the region of lens port 44*a*. It is noted that the lens assembly 15 includes, as noted above, two printed circuit boards 23, 24 having dielectric substrates 29, 31 with conductive metal clad to an outer surface 25, 27 thereof and strip conductor circuitry 33, 35 disposed on the inner surfaces thereof. The strip conductor circuitries 33, 35 formed on the pair of printed circuit boards 23, 24 are subtantially identical in the central portions thereof as mentioned above and when the printed circuit boards 23, 24 are fastened together in any conventional manner, it is noted that the center conductor circuitries 23, 24 on the printed circuit boards mate, in mirror fashion, as shown in FIG. 4. It is noted that the strip conductor circuitry 33 does not extend over the power divider/combiner portions of the strip conductor circuitry 35. It is also noted that the conductive metal strip conductor circuitries 33, 35 clad to the inner surfaces of the printed circuit boards 23, 24 integrally form what may be considered as a composite conductor except over the region of the power divider/combiner 46*a*. It is still further noted that the composite conductor, made up of circuitries 33, 35, exists over the parallel plate region 37 and over a pair of tapered, triangular-shaped feeds 51, 53 which together couple the parallel plate region 37 to the power divider/combiner 46 to provide lens port 44''*a*. The strip transmission line power divider/combiner 46*a* is coupled to lens port 44*a* (FIG. 1) and includes (as shown in FIGS. 4 and 5), as a part of center conductor circuitry 35, a pair of branch lines 60, 62 which are coupled to the pair of tapered triangular-shaped feeds 51, 53 formed by triangular-shaped conductors of the mated center conductor circuitries 33, 35 and a common line 66 formed by the mated center conductor circuitry 35 connected to beam port 20*a*, as shown. Beam port 20*a* includes a conventional coaxial connector 70 having its center conductor (not shown) electrically and mechanically connected to the strip conductor forming the common line 66 of the power divider/combiner 46*a* and the outer conductor electrically connected to the outer ground plane conductors 25, 27 formed by the copper clad to the outer surfaces of the printed circuit boards 23, 24. It is noted that the mated center conductor circuitry 35 forming the branch lines 60, 62 of the power divider/combiner 46*a* has its outer edges shaped in the form of three steps 70, 71, 72 to provide, along with tapered feeds 51, 53, impedance matching between the common line 66 and the lens port 44''*a*. Three conventional resistors 80, 81, 82 have the electrodes thereof connected between the branch lines 60, 62, as shown, to absorb mismatched or reflected energy and provide isolation between tapered feeds 51 and 53. That is, the power divider/combiner 46*a* is an isolated power divider/combiner with substantially little or no coupling between the branch lines 60, 62. It is noted from FIGS. 4, 5 and 6 that in order to physically accommodate the three resistors 80, 81, 82, portions of the dielectric substrate 29 of the upper printed circuit board 23 are removed to form pockets for the resistors 80, 81, 82. Since the packaging of the three resistors 80, 81, 82 uses substantially the same technique, FIG. 6 shows more clearly the arrangement used to package an exemplary one of the three resistors 80, 81, 82 here resistor 82. Thus, it is noted that the electrodes 92, 94 of resistor 80 are bonded to the center conductor circuitry 35 formed on the printed circuit board 24, in particular, branch lines 60, 62, and that the body or casing of resistor 80 lies across the branch lines 60, 62 of the center conductor circuitry 35. A pocket 96 formed in the upper printed circuit board 23 thus receives the volume of the resistor 80 to thereby allow the upper and lower printed circuit boards 23, 24 to have the center conductor circuitries or at least the central portion of such circuitries abut, as described. Referring again to FIG. 5, it should also be noted that the lengths of the branch lines 60, 62 of the power divider/combiner 46*a* are equal so that the electrical lengths from beam port 20*a* to the inputs 100, 102 at the apexes of the triangular-shaped, tapered feeds 51, 53 are equal. Further, the altitudes of the pair of triangular-shaped feeds 51, 53 are substantially equal. Therefore, the electrical lengths from the beam port 20*a*, through common conductor 66, branch lines 60, 62 to the bases 104, 106 of the triangular-shaped, tapered feeds 51, 53 are equal to each other with the result that radio frequency energy fed to beam port 20*a* is divided equally between the pair of triangular-shaped feeds 51, 53 and that the energy produced at the base of one of the triangular-shaped feeds is in phase with the energy produced at the base of the other one of the pair of triangular-shaped feeds. Consequently, the radiation pattern of the beam port is pointed perpendicular to the bases formed by triangular feeds 51, 53 in the plane of the lens.

Figure 7:
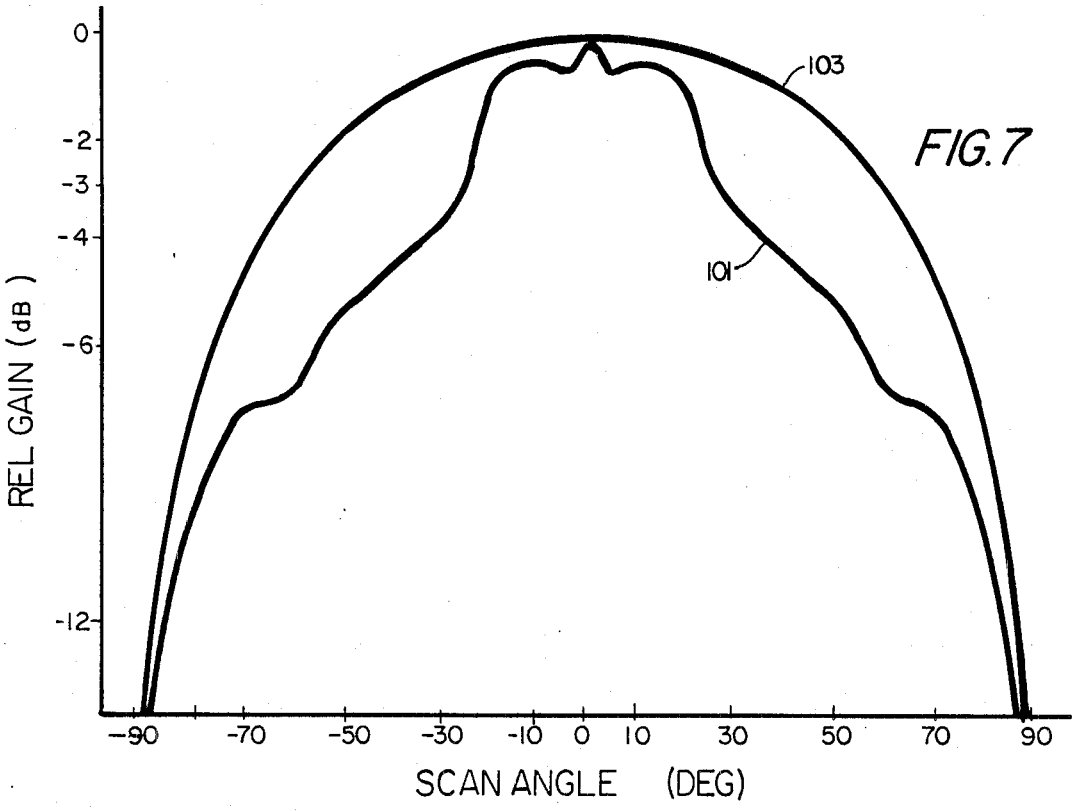
FIG. 7 is a diagram showing a comparison between a radiation pattern produced inside a radio frequency lens of a lens assembly according to the prior art and a radiation pattern produced inside a radio frequency lens of a lens assembly according to the invention when such lens assemblies operating at a frequency in the range between 0.52 $(d/\lambda)$ and 0.64 $(d/\lambda)$ where d is the width of a lens port of such radio frequency lenses and $\lambda$ is the operating wavelength.

Referring now to FIG. 7, a curve 101 shows the radiation pattern inside a radio frequency lens as a function of scan angle and lens port width (or spacing) d (FIG. 2) of a lens assembly according to the prior art having a single tapered feed 44*a'* as indicated by dotted line 110 in FIG. 2 and a curve 103 (FIG. 7) shows a radiation pattern inside the radio frequency lens assembly 17 as a function of scan angle. It is noted from FIG. 2 that the pair of tapered feeds 51, 53 forming each one of the lens ports 44*a* to 44*j*, and 45*a* to 45*j* is disposed within the space occupied by a single tapered feed 44*a'* according to the prior art lens (such as the lens described in U.S. Pat. No. 3,761,936 referred to above). Operation of a lens having a single tapered feed port 44*a'* as described in the referenced patent over a band of frequencies in the range of $(d/0.52)>\lambda>(d/0.64)$, where $\lambda$ is the operating wavelength and d is the separation between adjacent lens ports results in increased coupling coefficient ripple believed to be due to a high port active reflection coefficient and multiple lens internal reflections thereby resulting in a relatively narrow radiation pattern. Broader bandwidth lens designs usually require, however, operation in this region because array lens design considerations typically require antenna element spacing of $0.67>D/\lambda_{HI}>0.5$ when D is the spacing between adjacent ones of the antenna elements 14*a* to 14*j* and $\lambda_{HI}$ is the wavelength of the radio frequency energy having the highest frequency in the operating band in order to minimize the number of antenna elements for economic reasons while avoiding grating lobes for large arrays having maximum scan angles of 30 to 90 degrees. Further, it is often desirable to maximize power transfer between lens ports 44*a* to 44*j* and lens ports 45*a* to 45*j* thereby resulting in a lens expansion factor for central Rotman array ports having port widths equal to approximately $(1.2d/\lambda_{HI})$. By doubling, in accordance with this invention, the number of tapered feeds for each one of the lens ports 44*a* to 44*j*, 45*a* to 45*j*, while using isolated "in-phase", 2:1 power divider/combiners 46*a* to 46*j*, 48*a* to 48*j*, so that each lens port has a radiation pattern directed along a line in the plane of the lens perpendicular to the bases of the triangular-shaped feeds 51, 53, satisfactory operation of the antenna in the operating range of $0.64>(d/\lambda)>0.52$ may be obtained.

Having described a preferred embodiment of the invention, it will now be evident that many changes and modifications may be made without departing from the inventive concepts. For example, the number of antenna elements in the array and the number of beam ports may vary. It is felt, therefore, that this invention should not be restricted to the disclosed embodiment but rather should be limited only by the spirit and scope of the appended claims.

What is claimed is:

1. A radio frequency lens comprising: a plurality of lens ports disposed about a peripheral portion of such lens; each one of a first portion of adjacent ones of such plurality of lens ports including a plurality of tapered feeds; and a power divider/combiner coupled to each one of the adjacent ones of the plurality of lens ports, each one of such power divider/combiners having a plurality of branch lines coupled to the tapered feeds and a common line coupled to a port of the lens.

2. The radio frequency lens recited in claim 1 wherein the electrical lengths between the port and the plurality of tapered feeds are equal.

3. The radio frequency lens recited in claim 2 wherein each one of the plurality of power divider/combiners is an isolated power divider/combiner.

4. An antenna system for producing a plurality of differently directed beams of electromagnetic energy, each one of such beams being associated with a corresponding one of a plurality of beam ports, each one of such beams being produced from a common array of a plurality of antenna elements, such antenna system comprising: a radio frequency lens assembly having a plurality of array ports coupled to the plurality of antenna elements; such lens assembly comprising a radio frequency lens having a plurality of adjacent lens ports disposed about peripheral portions thereof, each one of a first portion of such plurality of lens ports being coupled to a corresponding one of the antenna elements through a corresponding one of the array ports, and each one of a second, opposing portion of the plurality of lens ports being coupled to a corresponding one of the beam ports; each one of the lens ports in one of the portions thereof including a pair of tapered feeds; and a power divider/combiner coupled to each one of the pair of tapered feeds, such power divider/combiner having a pair of branch lines coupled to the pair of tapered feeds and a common line coupled to the one of the beam ports or array ports coupled to such lens port.

5. The antenna system recited in claim 4 wherein the electrical lengths between an input to the common line of each one of said power divider/combiners and the outputs of the pair of tapered feeds coupled to the branch lines of such power divider/combiners are equal.

6. The antenna system recited in claim 5 wherein each one of the power divider/combiners is an isolated power divider/combiner.

* * * * *